US005180357A

United States Patent [19]

Marzullo

[11] Patent Number: 5,180,357

[45] Date of Patent: Jan. 19, 1993

[54] BUCKLE CHUTE PAPER STOP ADJUSTMENT MECHANISM

[75] Inventor: Joseph H. Marzullo, Brookfield, Conn.

[73] Assignee: Pitney Bowes Inc., Stamford, Conn.

[21] Appl. No.: 809,187

[22] Filed: Dec. 17, 1991

[51] Int. Cl.[5] ..... B65H 45/14

[52] U.S. Cl. ..... 493/420; 493/421

[58] Field of Search ..... 493/420, 421

[56] References Cited

U.S. PATENT DOCUMENTS

| | | | |
|---|---|---|---|
| 2,461,214 | 2/1949 | Holms | 493/421 |
| 3,178,171 | 4/1965 | Springer et al. | 493/421 |
| 3,516,655 | 6/1970 | Schmeck | 493/421 |
| 3,856,293 | 12/1974 | Boyer | 493/421 |
| 4,586,704 | 5/1986 | Lehmann et al. | 493/421 |
| 4,834,695 | 5/1989 | Boblit et al. | 493/421 |

FOREIGN PATENT DOCUMENTS

| | | | |
|---|---|---|---|
| 487178 | 12/1929 | Fed. Rep. of Germany | 493/420 |

*Primary Examiner*—William E. Terrell

*Attorney, Agent, or Firm*—Charles R. Malandra, Jr.; Melvin J. Scolnick

[57] ABSTRACT

A mechanism for adjusting the location of paper stops in folding machine buckle chutes is provided, employing a dual rack and pinion arrangement that is accessible from the side of the machine. The racks may be aligned during assembly to remove skew with respect to the paper path. The mechanism is reliable, low in cost, and allows simple and accurate adjustment of paper stops.

8 Claims, 3 Drawing Sheets

BUCKLE CHUTE PAPER STOP ADJUSTMENT MECHANISM

BACKGROUND OF THE INVENTION

This invention relates to paper folding machines, particularly to paper stops for buckle chutes in those machines.

Buckle chutes for paper folding machines are well known. In operation, a sheet of paper is fed by a set of rollers into a chute until the leading edge of the sheet comes into contact with a paper stop preventing further forward motion even as the rollers continue to feed the trailing edge of the sheet. The buckle chute is narrow enough that no portion of the sheet already in the buckle chute can move in anyway to accommodate the continued forward motion of the trailing edge. As a result the sheet buckles outside the chute into the nip between two further rollers which grab onto and begin pulling the sheet where it is buckled, creating a fold. Several buckle chutes may be arranged in series to create more than one fold.

Depending on the type or size of the documents to be folded, it may be necessary to select different fold positions by adjusting the location of the stops in the buckle chutes, which determines how far the sheet proceeds into the buckle chute before it begins to buckle.

Previously, this has necessitated either removing the buckle chute apparatus from the folding machine to obtain access to the stops and manually adjusting them, or a complex and expensive arrangement for translating the stops while the chute is in the machine.

It would be desirable to provide a folding machine buckle chute paper stop adjustment mechanism that is simple to adjust.

It would further be desirable to provide a folding machine buckle chute paper stop adjustment mechanism that allows the machine operator to adjust the stops from the side of the machine without disassembling the buckle chute and that is reliable and inexpensive to produce.

It would still further be desirable to provide a buckle chute paper stop adjustment mechanism for a folding machine that allows adjustment of the stop location without skewing the paper stop.

SUMMARY OF THE INVENTION

It is an object of the invention to provide a buckle chute paper stop adjustment mechanism that is simple to adjust.

In accordance with the present invention, there is provided a folding machine buckle chute with a first sidewall having lateral edges, and a second sidewall having lateral edges and being spaced from and substantially parallel to the first sidewall and forming a paper channel between, and a paper stop projecting substantially perpendicularly from a position along one of the sidewalks across the channel toward the other of the sidewalls, and paper stop adjustment means for adjusting the position along the one of the sidewalls, where the adjustment means comprises a carrier to which the paper stop is attached, and translation means fixing the carrier means to the one of the sidewalls and allowing translation of the carrier along the one of the side walls parallel to the lateral edges, and actuation means linked to the carrier means and extending substantially parallel to the lateral edges for allowing actuation of the translation means to translate the carrier along the sidewall to position the stop where desired.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Folding machines are commonly used to fold sheets of paper—for example, for high-volume mail applications. Typically with these machines, single or multiple sheets are folded at least once, then conveyed to an inserter or envelope stuffer. In folders, buckle chutes perform the function of restraining the leading edge and a substantial leading portion of a sheet of paper as it is urged forward by rollers The sheet buckles because it is both restrained by the chute and pushed forward by the rollers. The chutes are arranged so that the buckled portion is picked up by further rollers that fold the paper in the region of the buckle. Multiple folds may be formed by cascading a series of buckle chute and roller arrangements.

It may be desired to fold sheets of paper of different sizes or to relocate the position of the fold on the sheets. In either case, it is necessary to adjust the location of the paper stop, as this determines at which point in a sheet's travel the sheet contacts the stop, and therefore at which point the sheet buckles and is folded. If the slot is positioned close to the entrance to the buckle chute, sheets buckle soon after entering. The resulting fold is then near to the leading edge of the sheet. If the paper stop is positioned far from the entrance to the buckle chute, however, the fold is made near the trailing edge. The present invention provides for the simple and accurate adjustment of the buckle chute stop position by turning a knob that is readily accessible from the side of the folding machine. The adjustment mechanism of the invention preferably has a pair of parallel rack and pinion drives, both of which are actuated by a knob to adjust the paper stop. The use of two linked rack and pinion drives assures that the paper stop is not skewed as it is aligned. To further eliminate skew, means is provided on at least one of the two racks for translational adjustment of the two racks during assembly of the apparatus. The adjustment mechanism may be preferably formed from inexpensive molded plastic parts, common parts further reducing the cost of the mechanism. Additional features of the invention will be presented in view of the following description of a typical folding machine buckle chute.

Figure 1:
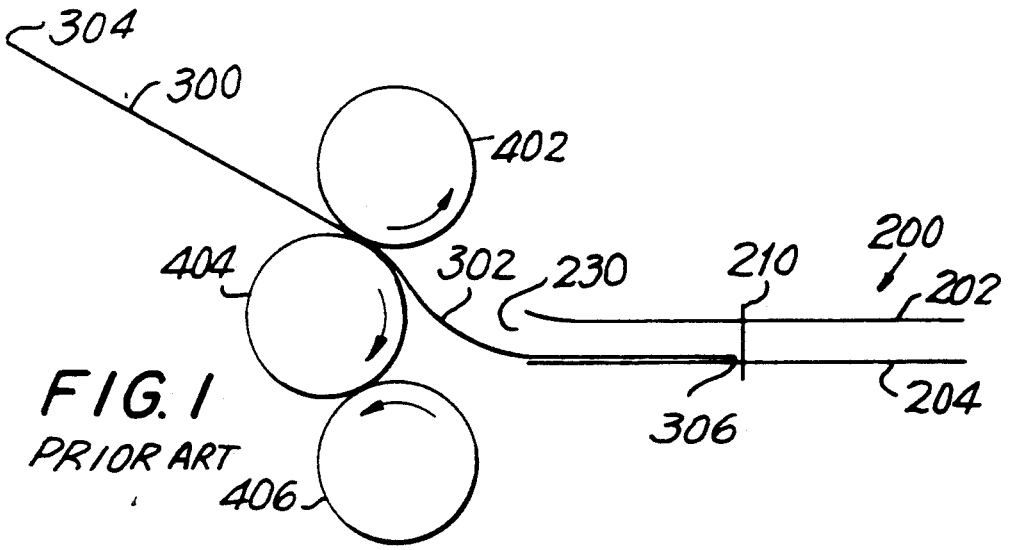
FIG. 1 PRIOR ART
FIG. 1 is a schematic diagram showing the function of the rollers, buckle chute and paper stop in a paper folding machine.
Figure 2:
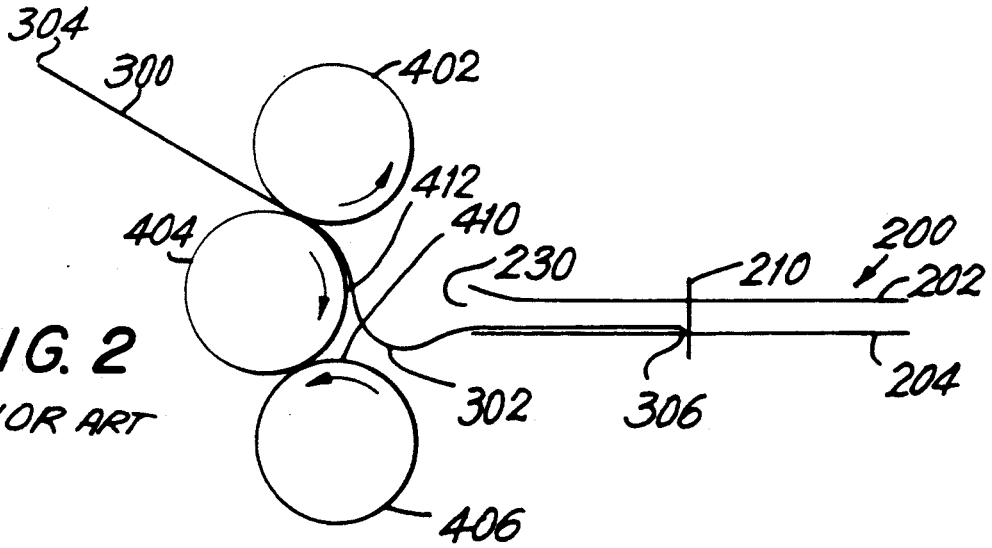
FIG. 2 PRIOR ART
FIG. 2 is a schematic diagram of the folding machine of FIG. 1 as the paper starts to buckle.
Figure 3:
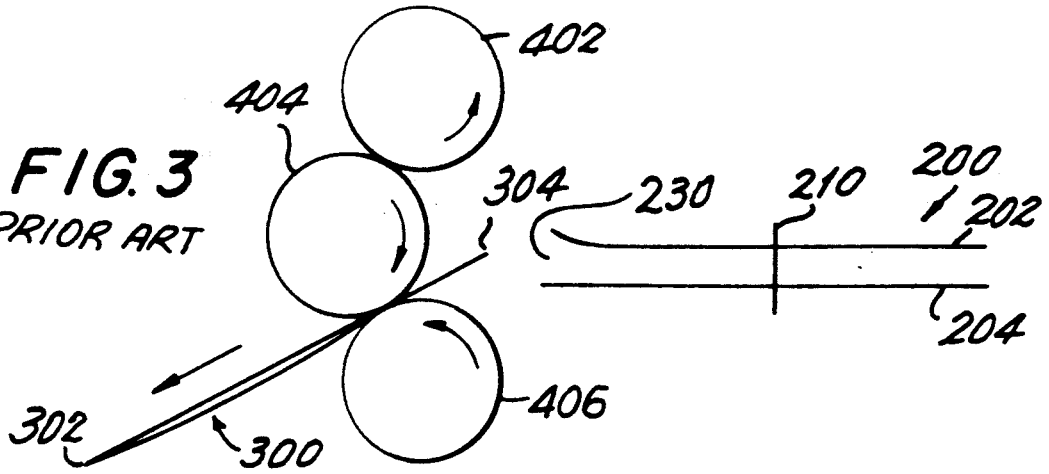
FIG. 3 PRIOR ART
FIG. 3 is a schematic diagram of the folding machine of FIGS. 1 and 2 after the paper has been folded.

Referring to FIG. 1, in a typical folding machine paper sheet 300 is fed between counterclockwise-rotating roller 402 and clockwise-rotating roller 404, which urge lending edge 306 of sheet 300 through entrance slot 230 of buckle chute 200 until edge 306 contacts paper stop 210. Because sheet 300 is both (a) urged in a direction toward buckle chute 200 by rollers 402 and 404 and (b) held by the combination of buckle chute sidewalls 202 and 204 and paper stop 210, sheet 300 buckles at fold position 302. Shown in FIG. 2, the continuation of the buckling process forces fold position 302 closer to roller surface 412 of roller 404 and roller surface 410 of counterclockwise-rotating roller 406. As shown in FIG. 3, when sheet 300 contacts roller surfaces 410 and 412, sheet 300 is drawn between rollers 406 and 404, folding sheet 300 at fold position 302. Depending on the desired application, the folding machine may be configured such that sheet 300 is cascaded into another buckle chute for further folding, or is inserted into an envelope.

The placement of the fold in sheet 300 at fold position 302 is controlled by the position of stop 210 in buckle chute 200. For example, if stop 210 had been at a location further from entrance slot 230, a greater length of sheet 300 would have been fed through rollers 402 and 404 before edge 306 contacted stop 210. Fold position 302 would thus have been located further from edge 306 and closer to paper edge 304. If paper size is changed, or a new fold position is required, the stops must be adjusted An illustrative embodiment of the present invention, buckle chute paper stop adjustment mechanism 10, is shown in FIG. 4.

Figure 4:
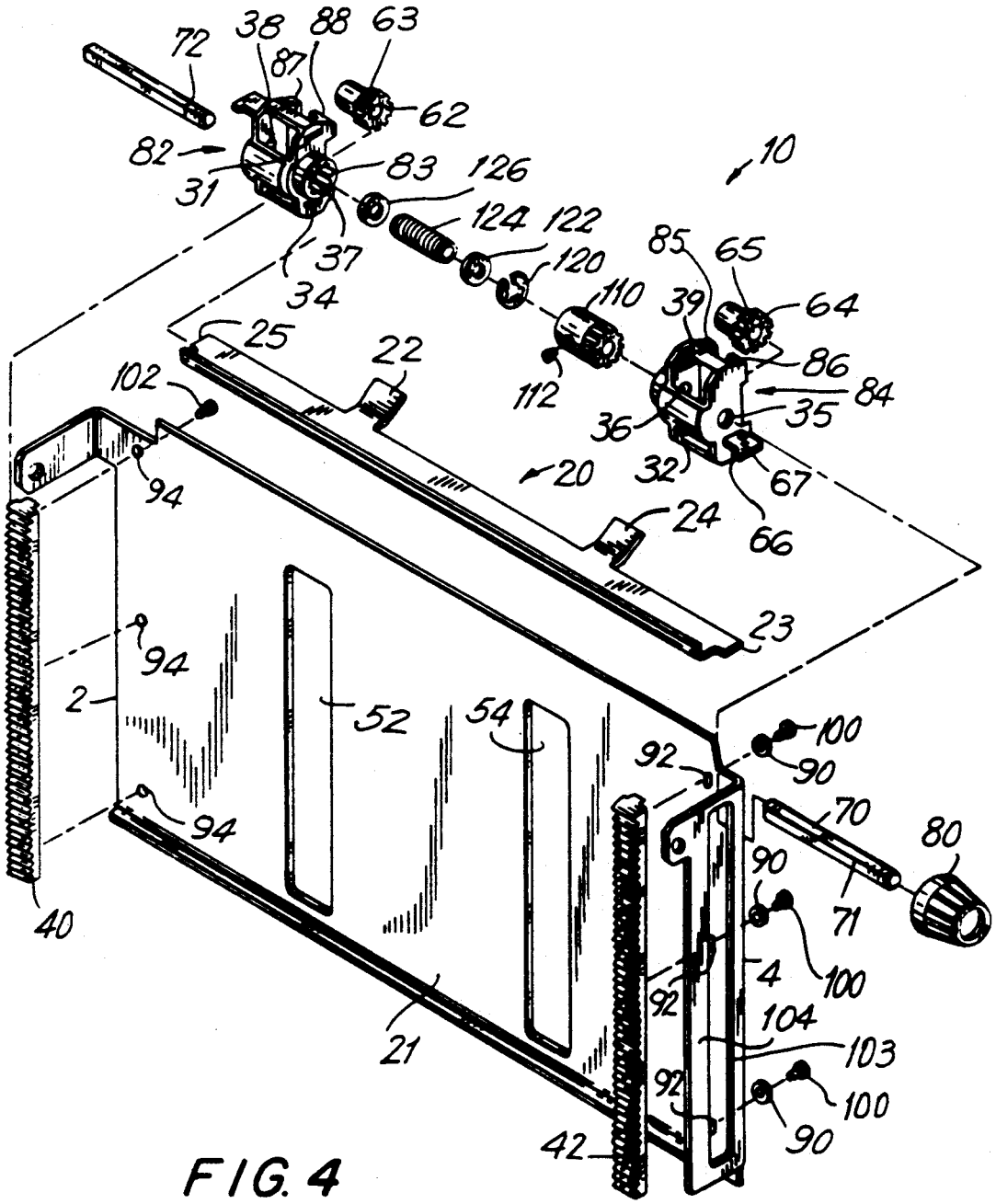
FIG. 4 is an exploded perspective view of a preferred embodiment of the paper stop adjustment mechanism of the present invention.
Figure 5:
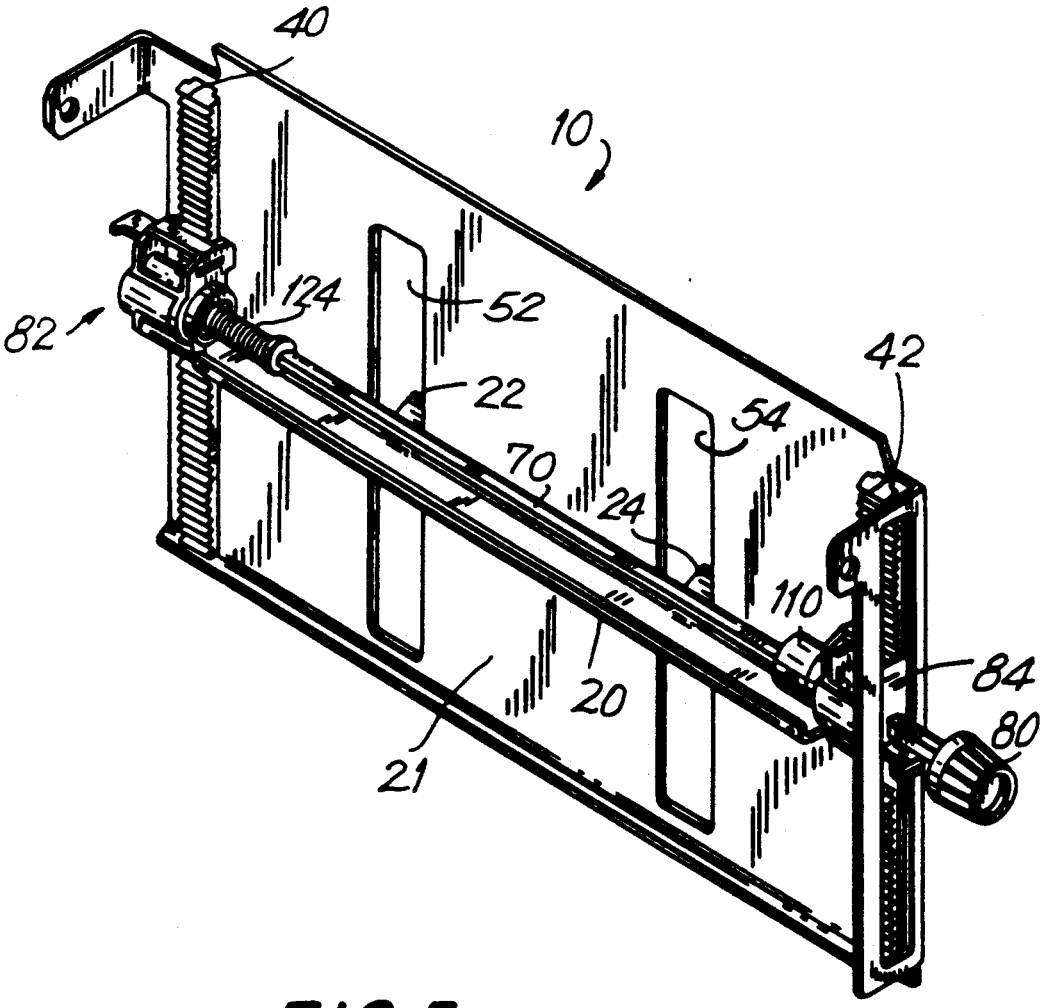
FIG. 5 is an assembled perspective view of a preferred embodiment of the paper stop adjustment mechanism of the present invention.

Referring to FIGS. 4 and 5, paper stop 20 has angled members 22 and 24 for assisting the capture of sheet 300. Paper stop ends 25 and 23 are inserted into slots 34 and 32 in gear housings 82 and 84 respectively. Gears 62 and 64 also fit into housings 82 and 84 respectively Gears 62 and 64 have axial bores 63 and 65 respectively, and allow shaft 70 to reciprocate axially. Locking edge 71 of shaft 70 engages looking edges 63 and 65 of gears 62 and 64, such that the rotation of shaft 70 produces a like rotation of gears 62 and 64. Shaft 70 rotates freely in holes 37 and 38 of housing 82, while holding gear 62 in place. Similarly, shaft 70 rotates freely in holes 35 and 36 of housing 84, while holding gear 64 in place. When assembled, the wider, toothed portion of T-shaped rack 40 is fitted into housing 82 between gear 62 and holding members 87 and 88 of housing 82. Similarly, wider, toothed portion of T-shaped rack 42 is fitted into housing 84 between gear 64 and holding members 85 and 86 of housing 84. In this manner, housings 82 and 84 are attached for sliding motion to racks 40 and 42, respectively. When assembled, this sliding motion along the rack and pinions is parallel to lateral edges 2 and 4 of sidewall 21.

Rack 40 is attached to buckle chute sidewall 21 by screws 102 through holes 94. Rack 42 is attached to sidewall 21 by screws 100 and plastic washers 90 through holes 92. The position of rack 42 is adjustable during assembly, as holes 92 are elongated. This adjustability allows paper stop 20 to be accurately aligned perpendicularly to the paper path during assembly. After adjustment, screws 100 are tightened, forcing plastic washers 90 to engage an embossed section (not shown) adjacent to holes 92 on the rear of buckle chute sidewall 21. This embossed section helps hold rack 42 firmly in place. Both racks 40 and 42 have tapped holes (not shown) to accept screws 102 and 100.

Gear 110 is attached to shaft 70 with screw 112, which prevents motion of gear 110 relative to the shaft. Clip 120 fits into groove 72 of shaft 70 preventing axial motion of clip 120 relative to shaft 70 and compressing spring 124 between washers 126 and 122 and housing 82. Compressed spring 124 urges gear 110 into housing 84. Shaft 70 is rotationally locked, as gear 110 engages locking teeth in housing 84 (the locking teeth of housing 84 are identical to locking teeth 83 shown on companion housing 82).

During assembly, tab 67 is inserted into groove 103 of sidewall 21 Extended portion 66 of tab 67 provides a means of visual reference as portion 66 may be aligned with alignment marks (not shown) on portion 104 of side wall 21, aiding the selection of the position of stop 20.

In operation, knob 80, which is press-fit onto shaft 70 and is accessible at the side of the buckle chute, is pushed toward housing 84 removing gear 110 from housing 84 and allowing the free rotation of shaft 70. By rotating knob 80 and thus shaft 70, gears 63 and 64 are rotated. As gears 63 and 64 engage racks 40 and 42, respectively, the rotation of gears 63 and 64 translates shaft 70, and thus housings 84 and 82 and attached paper stop 20, in a direction parallel to the longer, longitudinal axes of racks 40 and 42. Members 22 and 24 protrude through grooves 52 and 54 to contact sheet 300 (not shown) When the desired position of paper stop 20 has been obtained, the user releases knob 80. This allows compressed spring 124 to press on clip 120 moving shaft 70 and returning gear 110 into housing 84, rotationally locking shaft 70.

Similarly, a groove 72 could be formed on shaft 70 at a position where clip 120, when attached, would hold spring 124 against housing 84, so that shaft 70 is urged in a direction away from knob 80. In such a case gear 110 could be attached to shaft 70 so as to be received into teeth 83 of housing 82 when at rest, achieving the same locking action would have been obtained as above. However, in this case, to release the shaft, knob 80 would be pulled to compress spring 124 and separate gear 110 from teeth 83, rather than pushed as above.

Many of the components of buckle chute paper stop adjustment mechanism 10 may be constructed of molded plastic, and some of the parts are identical such as racks 40 and 42, housings 82 and 84, and gears 62 and 64. In the case of housing 82 and 84, this sometimes results in unused portions on one of the housings, for example, tab 67 and teeth 83 are not employed by housing 82. Housings 82 and 84 were also designed so that slot 32, used on housing 84, corresponds to slot 31 on housing 82, which is not used. Similarly, slot 34 used on housing 82 corresponds to slot 39 on housing 84, which is not used. Parts that are identical require only a single mold each, reducing manufacturing costs. An additional advantage of the present invention is that the location of knob 80, and overall structure of mechanism 10 allows mechanism 10 to be mounted in a frame such that knob 80 is accessed from the side of the machine.

As both rack and pinions are driven positively by a common shaft, the paper stop position may be accurately determined without introducing skew. Paper stop skew that is present at the time of assembly may be removed by aligning the racks before fastening them to the chute.

Thus it is seen that a folding machine buckle chute paper stop adjustment mechanism that is simple to accurately adjust and is low in cost is provided. The mechanism allows the machine operator to adjust the stops from the side of the machine without disassembling the buckle chute and is reliable and inexpensive to produce. The invention also provides a buckle chute paper stop adjustment mechanism for a folding machine that allows adjustment of the stop location without skewing the paper stop. One skilled in the art will appreciate that the present invention can be practiced by other than the described embodiments, which are provided for purposes of illustration and not of limitation, and the present invention is limited only by the claims which follow.

What is claimed is:

1. In a folding machine buckle chute comprising: a first side wall having lateral edges, a second sidewall having lateral edges and being spaced from and substantially parallel to the first sidewall and forming a paper channel between and a paper stop having at least one member projecting substantially perpendicularly from a position along one of said sidewalls across said channel toward the other of said sidewalls, a paper stop adjustment mechanism comprising:

translation means coupled to said paper stop for fixing said carrier means to said one of said sidewalls and for translating said paper stop along said one of said sidewalls parallel to said lateral edges, and actuation means linked to said translation means for actuating said translation means from one of said lateral edges to translate said paper stop along said sidewall to position said stop where desired, wherein said translation means includes a first rack and pinion means having a first rack and a first gear for translating said paper stop; and a first housing in which said first gear is disposed for engaging said first rack, said first housing having a portion defining a first slot for holding one end of said paper stop.

2. The mechanism of claim 1, wherein said translation means further comprising:

a second rack and pinion means having a second rack and a second gear for translating said paper stop; and a second housing in which said second gear is disposed for engaging said second rack, said second housing having a portion defining a second slot for holding an other end of said paper stop, wherein said first slot and said second slot hold said paper stop substantially perpendicular to said lateral edges.

3. The mechanism of claim 2 wherein:

said actuation means comprises a shaft disposed substantially perpendicularly to said lateral edges, said shaft having a shaft engagement surface; and said translation means further comprises:

a first axial bore disposed in said first gear for receiving said shaft therewithin said first axial bore having a first bore engagement surface for engaging said shaft engagement surface for positive rotational motion; and a second axial bore disposed in said second gear for receiving said shaft therewithin, said second axial bore having a second bore engagement surface for engaging said shaft engagement surface for positive rotational motion.

4. The mechanism of claim 3 wherein said translation means further comprises:

means for attaching said first rack and pinion means to said one of said sidewalls; and adjustable means for attaching said second rack and pinion means to said one of said sidewalls in an adjustably fixed position along said one of said sidewalls in a direction parallel to said lateral edges for aligning said paper stop.

5. The mechanism of claim 4 wherein said adjustable means for attaching said second rack and pinion means comprises:

a portion of said second rack having a plurality of tapped holes therein;

a plurality of screws for screwing into said tapped holes;

portions of said one of said sidewalls having a plurality of elongated screw holes therein, said elongated screw holes having elongated axes parallel to said lateral edges for allowing said second rack to be adjustably moved during assembly parallel to said lateral edges;

at least one embossed region on said one of said walls disposed adjacent to at least one of said elongated screw holes; and at least one plastic washer for compression between one of said screws and one of said embossed regions for attaching said second rack to said one of said sidewalls 6. The mechanism of claim 3 wherein said translation means further comprises:

a first portion of said first housing defining a first bore for receiving said shaft within for reciprocating and rotational motion; and a second portion of said second housing defining a second bore for receiving said shaft within for reciprocating and rotational motion.

7. The mechanism of claim 3 wherein said actuation means further comprises:

a locking gear attached to said shaft;

a spring disposed on said shaft between (a) one of said first housing and said second housing and (b) a spring holding means disposed on said shaft and longitudinally fixed with respect to said shaft;

locking teeth on one of said first housing and said second housing for engaging said locking gear; and a knob attached to said shaft for extending beyond the body of the buckle chute to provide access from a side of the folding machine, wherein:

said spring normally urges said locking gear in a first direction toward said locking teeth, said locking gear engaging said locking teeth and rotationally locking said shaft, thereby preventing translation of said paper stop; and said shaft may be urged in a second direction opposite to said first direction, compressing said spring between (a) said one of said first and said second housings and (b) said holding means, thereby disengaging said locking gear from said locking teeth, and allowing rotation of said shaft for translation of said paper stop.

8. The mechanism of claim 2 wherein at least one of said first housing and said second housing has a tab for visual indicating alignment said paper stop.

* * * * *